US012782082B1

(12) United States Patent
Roth

(10) Patent No.: US 12,782,082 B1
(45) Date of Patent: Nov. 3, 2026

(54) SHOCK ABSORBING STOCK WITH ADJUSTABLE LENGTH OF PULL

(71) Applicant: Mark John Roth, Appleton, WI (US)

(72) Inventor: Mark John Roth, Appleton, WI (US)

( * ) Notice: Subject to any disclaimer, the term of this patent is extended or adjusted under 35 U.S.C. 154(b) by 0 days.

(21) Appl. No.: 19/338,528

(22) Filed: Sep. 24, 2025

Related U.S. Application Data

(60) Provisional application No. 63/698,999, filed on Sep. 25, 2024.

(51) Int. Cl.
*F41C 23/06* (2006.01)
*F41C 23/14* (2006.01)

(52) U.S. Cl.
CPC ..... *F41C 23/06* (2013.01); *F41C 23/14* (2013.01)

(58) Field of Classification Search
CPC ..... F41C 23/14; F41C 23/06; F41C 23/08
USPC ..... 42/71.01–74
See application file for complete search history.

(56) References Cited

U.S. PATENT DOCUMENTS

| | | | | |
|---|---|---|---|---|
| 3,137,958 | A | 6/1964 | Lewis et al. | |
| 3,707,797 | A | 1/1973 | Ruth | |
| 4,663,877 | A | 5/1987 | Bragg | |
| 5,031,348 | A * | 7/1991 | Carey | F41C 23/14 42/74 |
| 5,392,553 | A | 2/1995 | Carey | |
| 5,410,833 | A | 5/1995 | Paterson | |
| 5,909,002 | A | 6/1999 | Atchisson | |
| 6,732,466 | B2 | 5/2004 | Bentley | |
| 8,505,226 | B2 * | 8/2013 | Vesligaj | F41C 23/06 42/1.06 |
| 8,943,726 | B2 | 2/2015 | Kincel | |
| 9,915,498 | B1 | 3/2018 | Spuhr | |
| 10,317,165 | B2 | 6/2019 | Saltzman | |
| 2002/0053156 | A1 | 5/2002 | McCarthy | |
| 2013/0145668 | A1 | 6/2013 | Valin | |
| 2014/0224112 | A1 | 8/2014 | Verry | |

FOREIGN PATENT DOCUMENTS

| | | | |
|---|---|---|---|
| EP | 4296604 | 12/2023 | |
| FR | 2686686 A1 * | 7/1993 | F41C 23/06 |

OTHER PUBLICATIONS

Translation of EP4296604A1, as viewed at: https://patents.google.com/patent/EP4296604A1/en?oq=ep+4296604 on May 29, 2026. 11 Pages.

* cited by examiner

*Primary Examiner* — Reginald S Tillman, Jr.
(74) *Attorney, Agent, or Firm* — Brannen Law Office, LLC

(57) ABSTRACT

A shock absorbing stock with adjustable length of pull is provided having a body with at least one cavity. A spring is received within the cavity. A butt pad is attached to a butt pad mount, and a pull rod is attached to the opposite side of the butt pad mount. A bushing with a central passage and a longitudinal passage is held in the cavity. The pull rod can be secured to the bushing with a pull rod lock. The length of pull is determined by which hole of the pull rod is used to secure the pull rod to the bushing. Firearm shock is absorbed as the butt pad is stopped by the user, causing the bushing, which is fixed to the pull rod, to compress the spring against the collar. The spring has the same spring rate regardless of the length of pull selected.

20 Claims, 8 Drawing Sheets

SHOCK ABSORBING STOCK WITH ADJUSTABLE LENGTH OF PULL

CROSS-REFERENCE TO RELATED APPLICATIONS

This United States utility patent application claims priority on and the benefit of provisional application 63/698,999 filed Sep. 25, 2024, the entire contents of which is hereby incorporated herein by reference.

BACKGROUND OF THE INVENTION

1. Field of the Invention

The present invention relates to a shock absorbing stock with adjustable length of pull.

2. Description of the Related Art

Many forces are produced when a firearm is discharged as a natural result of the combustion process used to propel a projectile. One of those forces is felt by the shooter as recoil. Felt recoil is undesirable as it can interfere with shooter comfort and safety (potentially causing injury). Recoil also can have a negative effect on accuracy and can increase the time between when a shot is fired and when the target is reacquired. For these reasons, there has been many improvements in the firearm industry related to recoil management.

Another factor in firearm safety and accuracy is firearm sizing. That is, how well the user's body interacts with the firearm. For this reason, many firearm stocks have been developed having an adjustable putt pad location, or length of pull. Adjustment of the pull length is important so that the butt plate can be positioned correctly for use with a given user.

Thus, there exists a need for a shock absorbing stock with adjustable length of pull that solves these and other problems.

SUMMARY OF THE INVENTION

A shock absorbing stock with adjustable length of pull is provided having a body with at least one cavity. A spring is received within the cavity. A butt pad is attached to a butt pad mount, and a pull rod is attached to the opposite side of the butt pad mount. A bushing with a central passage and a longitudinal passage is held in the cavity. The pull rod can be secured to the bushing with a pull rod lock. The length of pull is determined by which hole of the pull rod is used to secure the pull rod to the bushing. Firearm shock is absorbed as the butt pad is stopped by the user, causing the bushing, which is fixed to the pull rod, to compress the spring against the collar. The spring has the same spring rate regardless of the length of pull selected.

There are many aspects of the present invention, which each can have unique and independent advantages, as set out in particular in the appended claims.

According to one advantage of the present invention, the butt pad length of pull is adjustable. In this regard, the stock can be sized as desired for the user.

According to another advantage of the present invention, the stock is a shock absorbing stock. This advantageously increases the firearm comfort, accuracy and safety.

According to a still further advantage of the present invention, the spring rate (compression rate) is non-affected by the length of pull. In this regard, the springs are neither stretched nor compressed as the length of pull is adjusted.

According to a still further advantage yet of the present invention, the spring is held internally within a cavity. This prevents pinch points and therefore enhances user safety.

According to a still further advantage yet of the present invention, the pull rod passes through the bushing and collar, which keeps the pull rod aligned with the cavity. Also, pull rod passes through the spring, which is compressed between the bushing and collar as the pull rod does not directly engage the spring.

According to a still further advantage yet of the present invention, the pull rod can extend forward through the collar when being adjusted and/or when the spring is compressed. This allows for a spring and cavity to be sized appropriately to achieve desired spring characteristics without regard for the pull rod length.

According to a further advantage yet of the present invention, a retainer is provided to hold the bushing within the cavity. This is advantageous as it allows for adjustment to the length of pull while the bushing remains in the cavity.

According to a still further advantage yet of the present invention, the pull rod lock passes through one or more sidewall slots. The end or ends of the pull rod lock engage the slot ends to act as travel stops for the bushing, and accordingly the butt pad.

According to a still further advantage yet of the present invention, the stock can be designed for use with a wide variety of firearm types. This is accomplished by designing the front end interface to match the rear end of a receiver that the stock is to be used with.

According to a still further advantage yet of the present invention, there can be more than one cavity to each receive a pull rod. Each pull rod moves along a rod axis, which is parallel to other rod axes. It is appreciated that multiple springs work in tandem with each other, but each spring operates independently, to achieve a cumulative dampening effect.

According to a still further advantage yet of the present invention, the pull rod can have an adjustment hole (adjacent to the butt pad mount) that is positioned so that the butt pad mount is adjacent to the rear end of the body resulting in no recoil management when the present invention is in this position.

Other advantages, benefits, and features of the present invention will become apparent to those skilled in the art upon reading the detailed description of the invention and studying the drawings.

DETAILED DESCRIPTION OF THE INVENTION

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Figure 1:
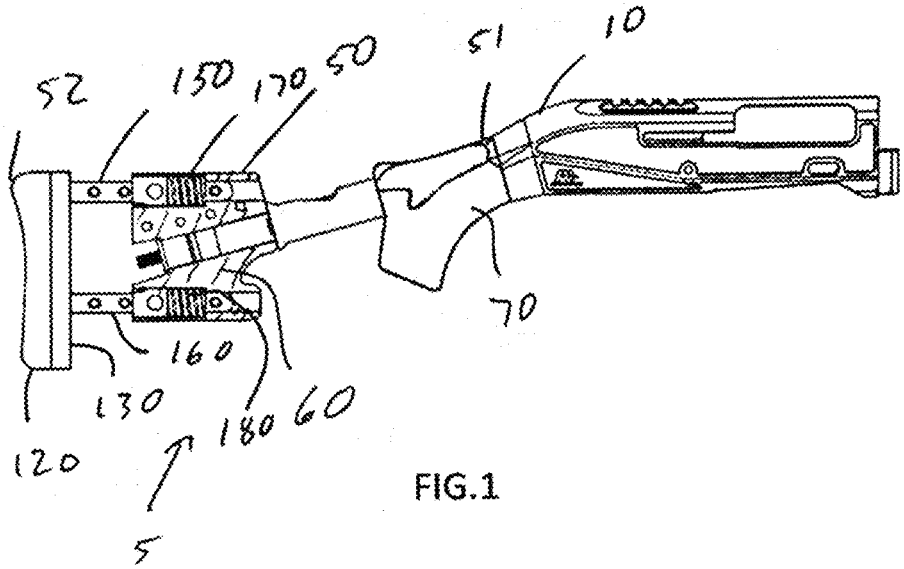
FIG. 1 is a side view of a firearm with an embodiment of a stock of the present invention attached to a receiver, wherein a portion of the body shown in cross section to illustrate the internal components.
Figure 2:
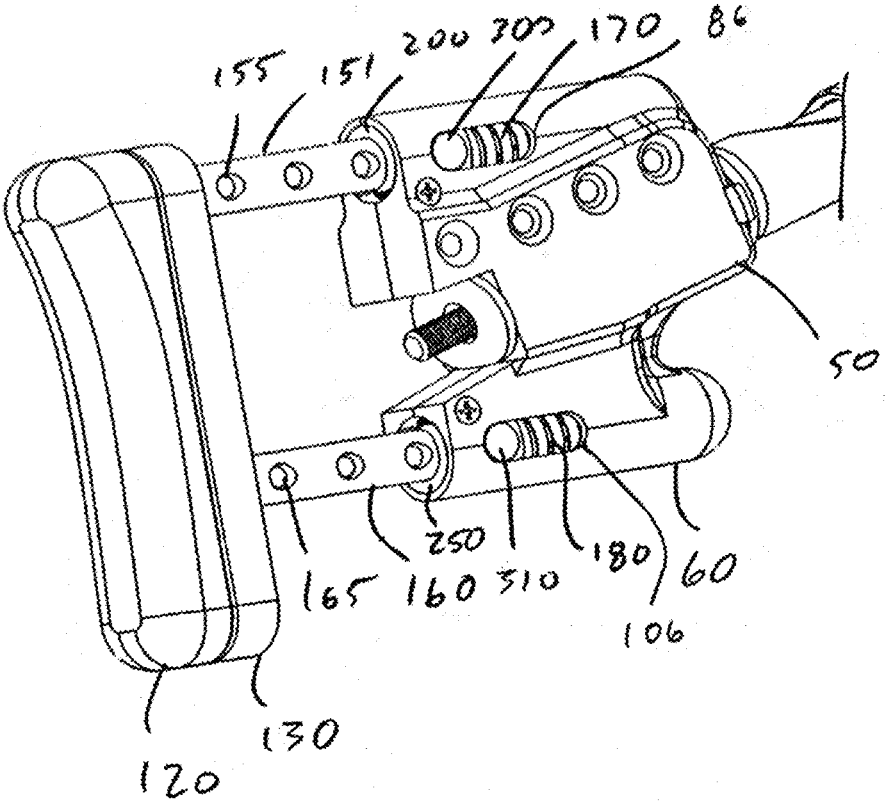
FIG. 2 is a rear perspective view of a portion of the embodiment of the stock illustrated in FIG. 1.
Figure 3:
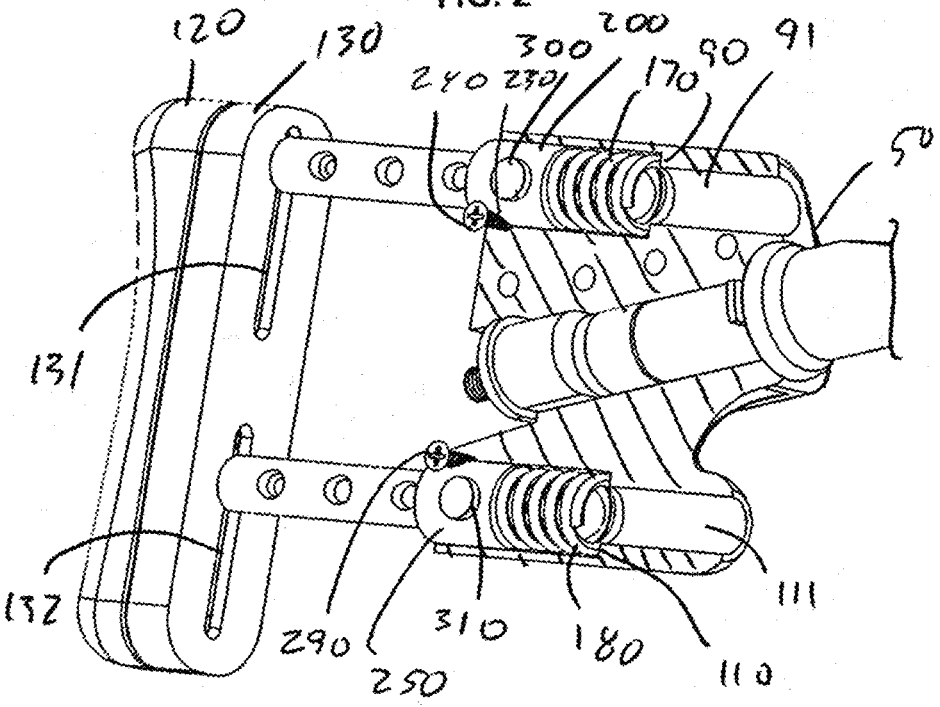
FIG. 3 is similar to FIG. 2 but shows the body in cross-section.
Figure 4:
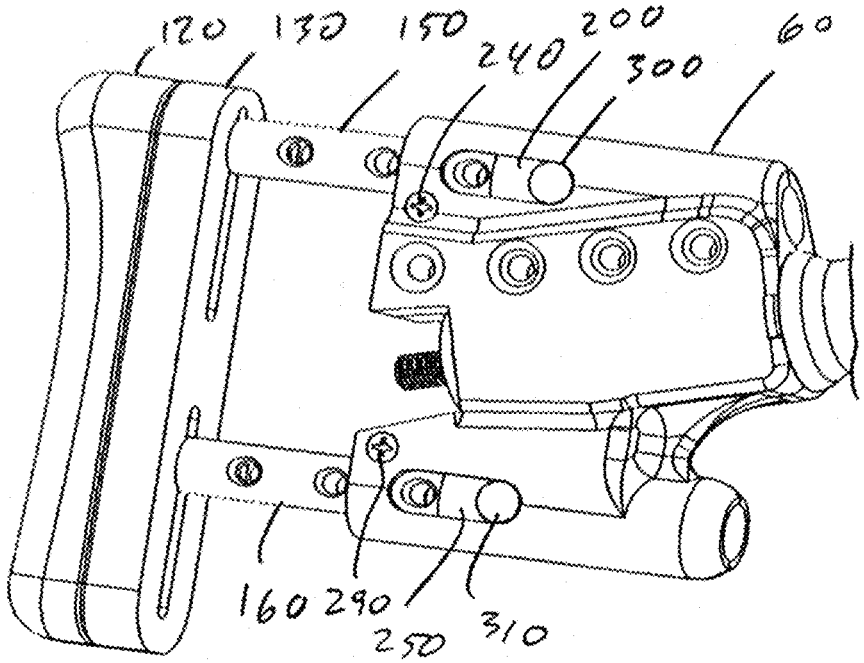
FIG. 4 is similar to FIG. 2 but shows the stock in a compressed state.
Figure 5:
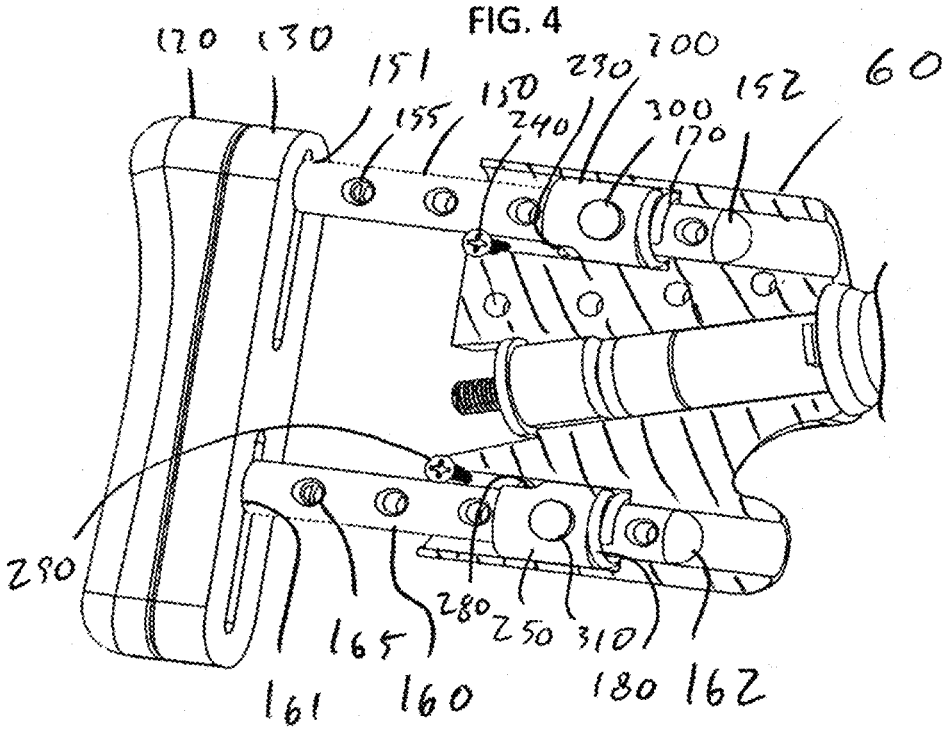
FIG. 5 is similar to FIG. 4 but shows the body in cross-section.
Figure 6:
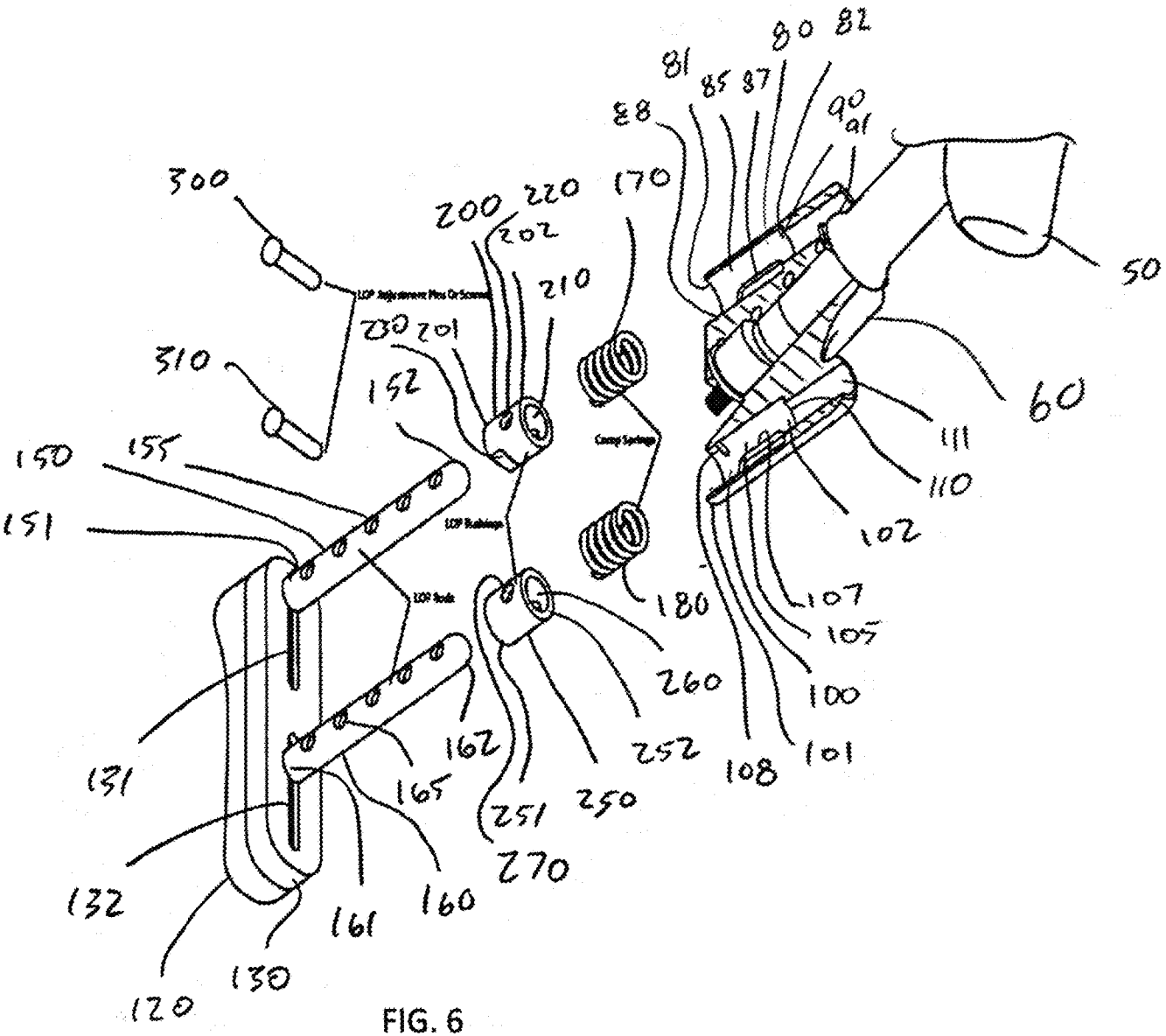
FIG. 6 is an exploded view of the stock illustrated in FIG. 1.
Figure 7:
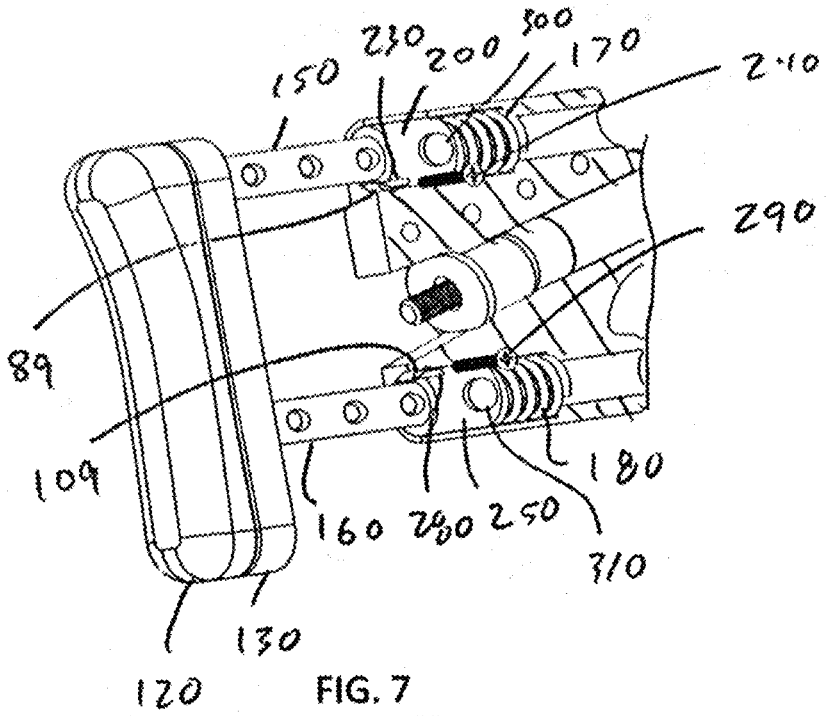
FIG. 7 is a is similar to FIG. 3 but shows the retainers in exploded view to illustrate the bushing reliefs.
Figure 8:
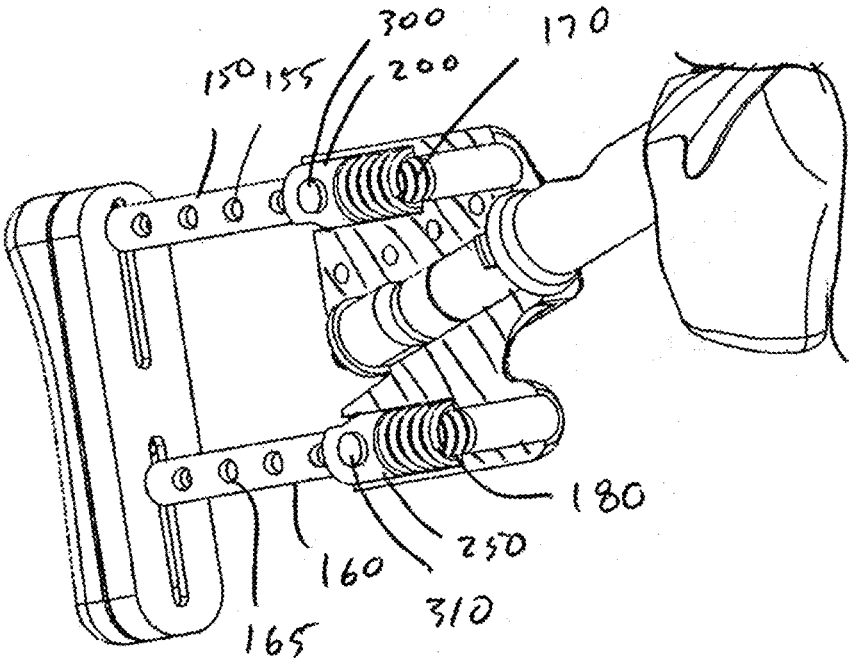
FIG. 8 is a perspective view, with the body shown in cross-section, showing a butt stock position with a selected length of pull.
Figure 9:
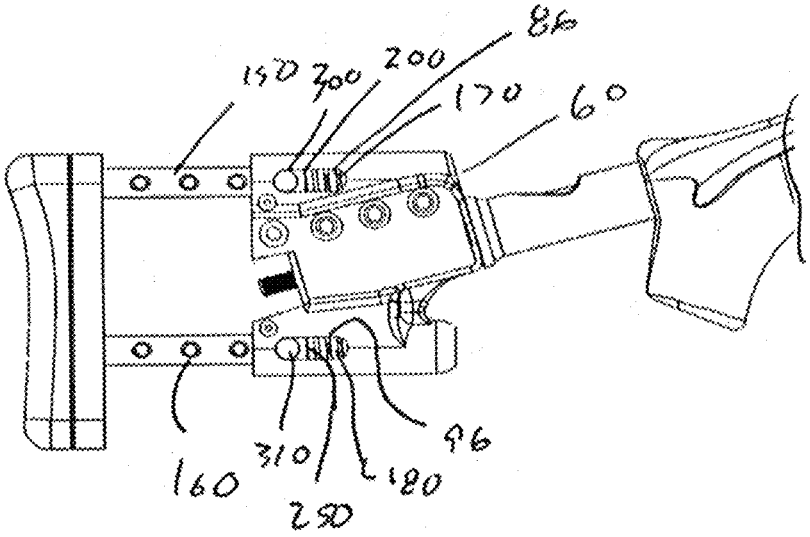
FIG. 9 is a side view showing a butt stock position with a different selected length of pull.
Figure 10:
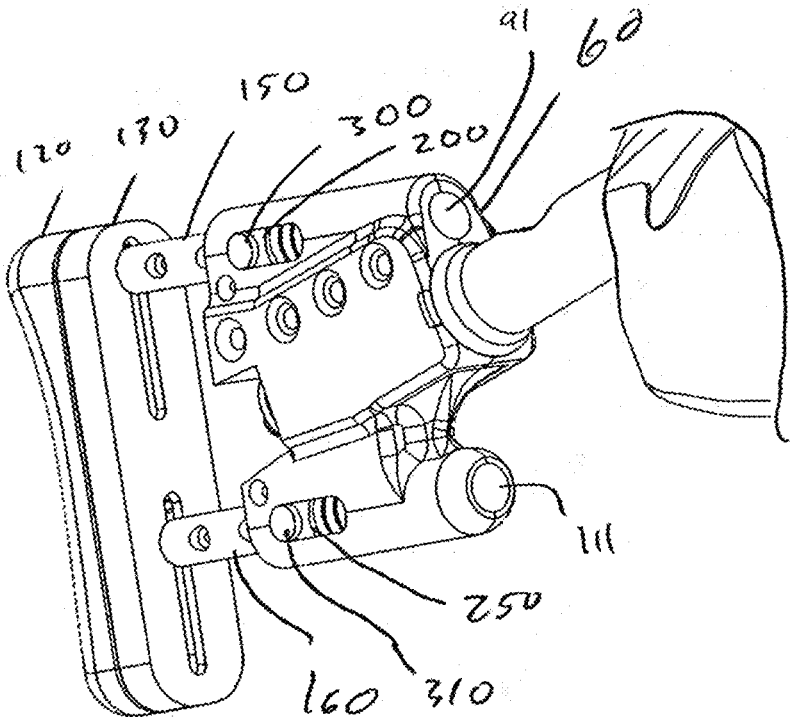
FIG. 10 is a perspective view showing a butt stock position with a different selected length of pull.
Figure 11:
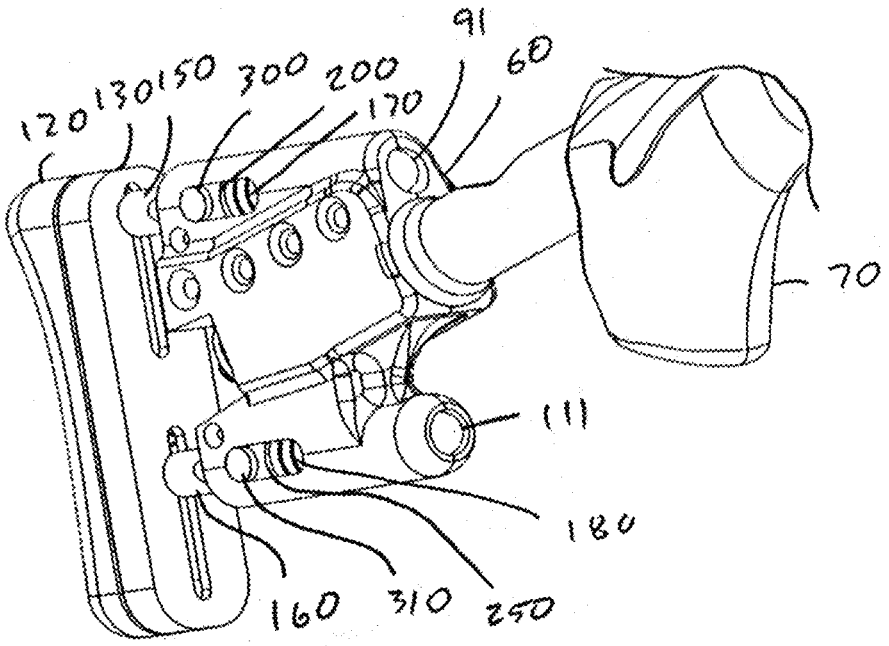
FIG. 11 is a perspective view showing a butt stock position with a different selected length of pull.

A preferred embodiment of a stock 50 is illustrated in FIGS. 1-12. The stock 5 can be connected to a receiver 10 of a firearm 5, as shown in FIG. 1.

The stock 50 has a first end (rear) 51 and a second end (front) 52. The stock 50 can have in a preferred embodiment a body 60, a butt pad 120, a butt pad mount 130, two pull rods 150 and 160, two springs 170 and 180, two bushings 200 and 250, two retainers 240 and 290, and two pull rod locks 300 and 310. Each of these components are described below.

The body 60 has a firearm interface 70 at the front end. The firearm interface 70 is designed to mate with the rear end of the particular firearm receiver. In this regard, the firearm interface 70 will vary in shape and size between various firearm models. In the preferred embodiment, the body 60 has two cavities 80 and 100.

Cavity 80 has a rear end 81 that is an open end, and has a front end 82 partially closed with a collar 90. The collar 90 has a central opening 91 therethrough. The cavity 80 has a cylindrical sidewall 85 with two slots 86 and 87 formed therethrough on opposite sides of the cavity 80. A laterally oriented retainer hole 88 is located near end 81. Retainer hole 88 can be a threaded hole to threadably receive a threaded retainer 240, as described below. Cavity 80 has a cavity diameter.

Cavity 100 has a rear end 101 that is an open end, and has a front end 102 partially closed with a collar 110. The collar 110 has a central opening 111 therethrough. The cavity 100 has a cylindrical sidewall 105 with two slots 106 and 107 formed therethrough on opposite sides of the cavity 100. A laterally oriented retainer hole 108 is located near end 101. Retainer hole 108 can be a threaded hole to threadably receive a threaded retainer 290, as described below. Cavity 100 has a cavity diameter.

It is appreciated that the cavities 80 and 100 have respective cavity axes that are parallel to each other. It is further appreciated that the present invention can be made with a single cavity, or with more than two cavities.

A butt pad 120 is removably securable to back of a butt pad mount 130. The butt pad mount has a front face with two slots 131 and 132 formed therethrough. Pull rod 150 is secured to the butt pad mount 130 through slot 131. Pull rod 160 is secured to the butt pad mount 131 through slot 132.

The butt pad 120 and butt pad mount 130 can be a referred to as a butt portion, and the rods 150 and 160 can be connected to the butt portion. Further, the butt pad 120 and butt pad mount 130 could be formed of a single piece.

Pull rod 150 has a first end 151 attached to the putt pad mount 130 and a second end 152 extended perpendicularly forward from the butt plate. A plurality of adjustment holes 155 are formed through the pull rod 150. In the illustrated embodiment, there are 5 holes. However, it is understood that there could be more or fewer holes.

Pull rod 160 has a first end 161 attached to the putt pad mount 130 and a second end 162 extended perpendicularly forward from the butt plate. A plurality of adjustment holes 165 are formed through the pull rod 160. In the illustrated embodiment, there are 5 holes. However, it is understood that there could be more or fewer holes.

Rods 150 and 160 are preferably parallel to each other. Each rod 150 and 160 preferably has the same rod diameter and rod length.

Spring 170 is received within cavity 80. The spring 170 has an end that engages collar 90.

Spring 180 is received within cavity 100. The spring 180 has an end that engages collar 110.

Springs 170 and 180 can have a spring compression rate, which can be the same for each spring.

Bushing 200 has a first end 201 and a second end 202. First end 201 has a relief 230 formed therein. A longitudinal passage 210 is through the bushing from end 201 to end 202. The longitudinal passage 210 has a longitudinal passage diameter that is slightly larger than the rod diameter. The bushing further has a lateral passage 220. The lateral passage is open on both sides of the bushing at diametrically opposed points about the bushing side perimeter. The lateral passage has a lateral passage diameter. The lateral passage preferably intersects the longitudinal passage at a right angle. Bushing 200 has a bushing diameter that is slightly smaller than the cavity diameter of cavity 80.

The bushing 200 is retained in the cavity 80 with retainer 240. The retainer 240 is threaded through the cavity side wall and is a travel stop (it engages relief 230 at the end of travel). Bushing 200 is constrained in movement in the opposite direction by spring 170. This positions the bushing adjacent to end 81 f cavity 80 when the stock is uncompressed.

Bushing 250 has a first end 251 and a second end 252. First end 251 has a relief 280 formed therein. A longitudinal passage 260 is through the bushing from end 251 to end 252. The longitudinal passage 260 has a longitudinal passage diameter that is slightly larger than the rod diameter. The bushing further has a lateral passage 270. The lateral passage is open on both sides of the bushing at diametrically opposed points about the bushing side perimeter. The lateral passage has a lateral passage diameter. The lateral passage preferably intersects the longitudinal passage at a right angle. Bushing 250 has a bushing diameter that is slightly smaller than the cavity diameter of cavity 100.

The bushing 250 is retained in the cavity 100 with retainer 290. The retainer 290 is threaded through the cavity side wall and is a travel stop (it engages relief 280 at the end of travel). Bushing 250 is constrained in movement in the opposite direction by spring 180. This positions the bushing adjacent to end 91 of cavity 90 when the stock is uncompressed.

Pull rod lock pin 300 is used to pull rod 150 in a longitudinal position relative to bushing 200. Pull rod lock pin 300 passes through slot 86, through a first part of lateral passage 220, through selected pull rod hole 155, through a second part of lateral passage 220 and into or through slot 87. Pull rod lock 300 is a travel stop for bushing 200. When comparing FIGS. 2 and 3 with FIGS. 4 and 5, it is seen that the pull rod lock 300 can engage opposite ends of the slot 86 at the outer limits of bushing travel.

Pull rod lock pin 310 is used to pull rod 160 in a longitudinal position relative to bushing 250. Pull rod lock pin 310 passes through slot 106, through a first part of lateral passage 270, through selected pull rod hole 165, through a second part of lateral passage 270 and into or through slot 107. Pull rod lock 310 is a travel stop for bushing 250. When comparing FIGS. 2 and 3 with FIGS. 4 and 5, it is seen that the pull rod lock 310 can engage opposite ends of the slot 96 at the outer limits of bushing travel.

It is appreciated that the any one of the adjustment holes 155 can be used to secure the pull rod 150 to the bushing 200. Further the corresponding adjustment hole 165 of pull rod can be used to secure pull rod 160 to bushing 250. The five effective pull lengths of the preferred embodiment are sequentially illustrated in FIGS. 8-12. It is understood that that the effective pull length does not affect the shock absorbing ability of the present invention when the stock 50 is configured as illustrated in FIGS. 8-11. Stated another way, the length of pull does not modify the spring rate of springs 170 and 180, as adjustment of the length of pull is independent of the spring compressibility. Hence, the length of pull is independent of the amount of dampening provided by the springs.

When the stock 50 is configured as shown in any of FIGS. 8-11, the present invention absorbs shock during a recoil event. This occurs as the bushing 200 moves towards the collar 90 when force is supplied to the bushing 200 in a sufficient amount to overcomes the spring force of spring 170. This recoil force develops as the firearm rearward travel is resisted by the user. The recoil force is transmitted from the user through the butt pad, butt plate and pull rod to the bushing. When the recoil force subsides, the spring 170 biases the bushing 200 rearward to the travel stop location.

The same forces operate between bushing 250 against spring 180 within cavity 100.

Figure 12:
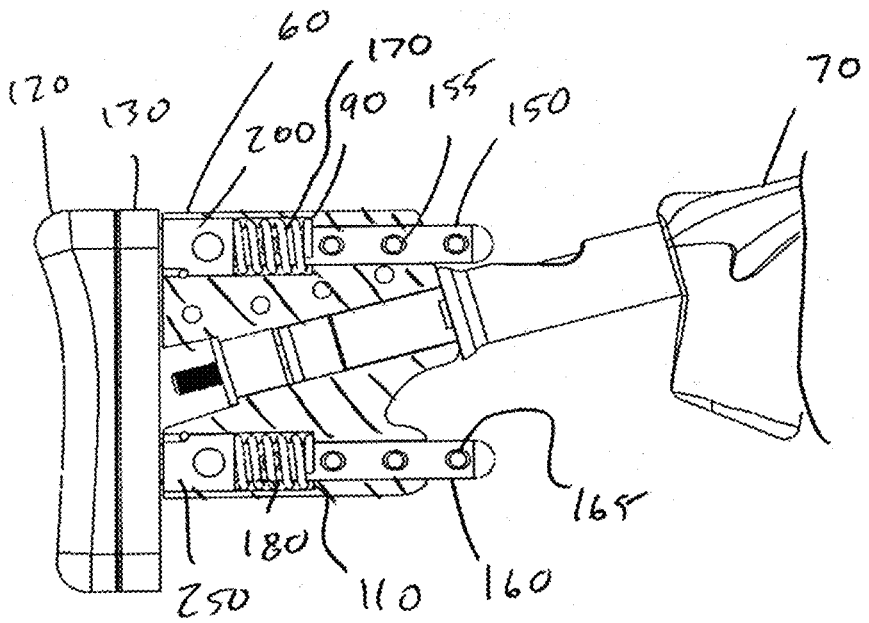
FIG. 12 is a side view, with the body shown in cross-section, showing a butt stock position with a different selected length of pull wherein there is no recoil management.

Turning now to FIG. 12, it is seen that butt pad mount 130 is adjacent to the rear end of the body 60. When locked this way, the present invention is configured for no recoil management.

It is appreciated that there are several unique structural features according to various aspects of the present invention. These features can be utilized individually or combined with other features in any possible way, such as being coupled with other features, tripled with other features and/or used all together without departing from the broad aspects of the present invention.

For example, a stock to absorb shock during a recoil event can comprise:

a body comprising:
a firearm interface;
a cavity having with first end and second end, the cavity having a collar at the second end;
a butt pad;
a pull rod, the pull rod having a plurality of adjustment holes;
a bushing, the bushing being retained within the cavity;
a spring within the cavity between the bushing and the collar; and
a pull rod lock, the pull rod lock connecting the pull rod to the bushing via one of the plurality of holes determine a length of pull,
wherein during the recoil event, the bushing compresses the spring against the collar.

This structure can also be combined with each other and/or with one or more of the following features:

having a second cavity, a second pull rod, a second bushing, and a second pull rod lock
having the plurality of adjustment holes be four holes
having the pull rod have a pull rod diameter, the collar have an opening with a collar diameter, and the pull rod diameter be smaller than the collar diameter
having the bushing have a relief on one end, and the body have a retainer hole for receiving a retainer, the retainer passing into the cavity to be a travel stop for the bushing It is further appreciated that there are several unique method features according to the present invention. These features can be utilized individually or combined with other features in any possible way, such as being coupled with other features, tripled with other features and/or used all together without departing from the broad aspects of the present invention.

Figure 13:
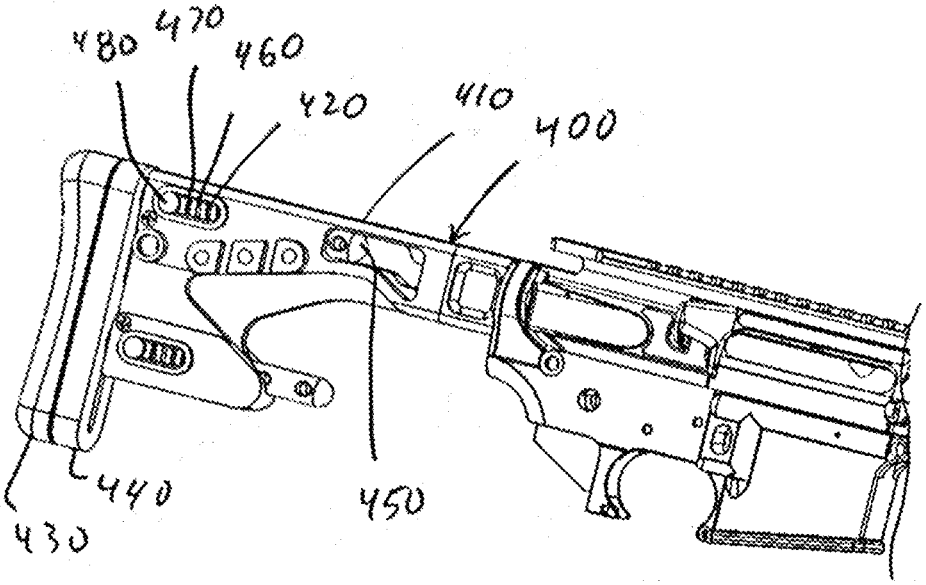
FIG. 13 is a perspective view of an alternative embodiment of a stock.

Turning now to FIG. 13, it is seen that an alternative embodiment of a stock 400. Stock 400 is similar to stock 50 in that it has a body 410, cavities 420, a butt pad 430, a butt pad mount 440, pull rods 450, springs 460, bushings 470 and pull rod locks 480. Stock 400 varies from stock 50 in that the body 410 has a different firearm interface so that it can be mated to a different firearm.

Figure 14:
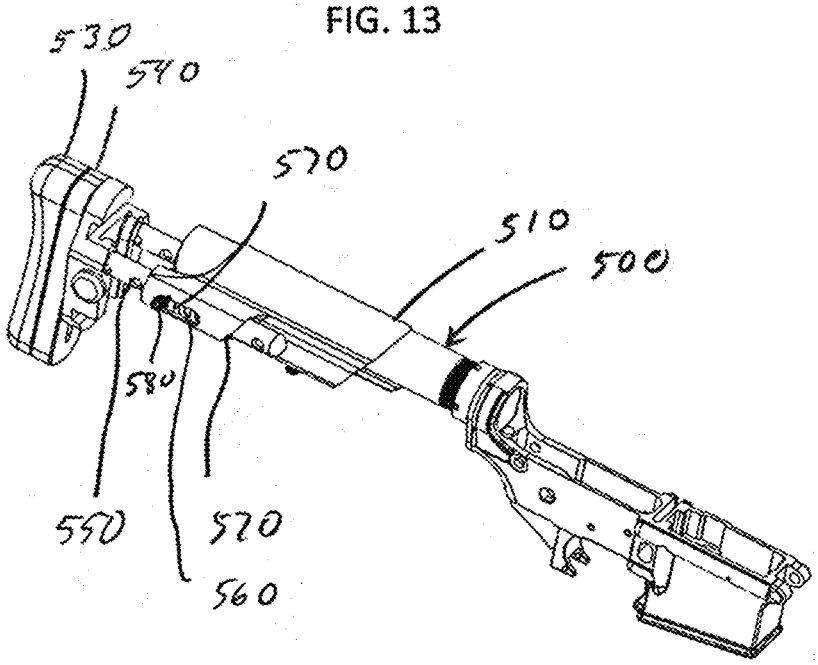
FIG. 14 is a perspective view of an alternative embodiment of a stock.

Turning now to FIG. 14, it is seen that an additional alternative embodiment of a stock 500. Stock 500 is similar to stock 50 in that it has a body 510, cavities 520, a butt pad 530, a butt pad mount 540, pull rods 550, springs 560, bushings 570 and pull rod locks 580. Stock 500 varies from stock 50 in that the body 510 has a different firearm interface so that it can be mated to a different firearm. Stock also varies in that the cavities 520 are horizontally aligned instead of vertically aligned. The cavity longitudinal axes are preferably parallel to each other.

Thus, it is apparent that there has been provided, in accordance with the invention, a shock absorbing stock with adjustable length of pull that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

The invention claimed is:

1. A stock to absorb shock during a recoil event, the stock comprising:

a body comprising:
a firearm interface;
a cavity having a first end and a second end, the cavity having a collar at the second end;
a butt pad;
a pull rod, the pull rod having a plurality of adjustment holes;
a bushing, the bushing being retained within the cavity;

a spring within the cavity between the bushing and the collar; and a pull rod lock, the pull rod lock connecting the pull rod to the bushing via one of the plurality of adjustment holes to determine a length of pull, wherein during the recoil event, the bushing compresses the spring against the collar.

2. The stock of claim 1 wherein the cavity is a first cavity and the pull rod is first pull rod, the stock further comprising:

a second cavity;

a second pull rod;

a second bushing; and a second pull rod lock.

3. The stock of claim 2 wherein the second cavity is below the first cavity.

4. The stock of claim 2 wherein the second pull rod is aligned parallel to the first pull rod.

5. The stock of claim 1 wherein the plurality of adjustment holes comprises five adjustment holes.

6. The stock of claim 1 wherein the pull rod has a pull rod diameter, the collar has an opening with a collar diameter, and the pull rod diameter is smaller than the collar diameter.

7. The stock of claim 6 wherein the collar opening is centrally aligned within the cavity.

8. The stock of claim 1 wherein:

the bushing has a relief on one end; and the body has a retainer hole for receiving a retainer, the retainer passing into the cavity to be a travel stop for the bushing.

9. The stock of claim 1 wherein length of pull is independent of an amount of dampening provided by the spring.

10. The stock of claim 1 wherein the bushing has a relief, and the stock further comprises a retainer to engage the relief to retain the bushing in the cavity.

11. A stock to absorb shock during a recoil event, the stock comprising:

a body comprising:

a firearm interface;

a first cavity having a first cavity first end and a first cavity second end, the first cavity having a first collar at the first cavity second end;

a second cavity having a second cavity first end and second cavity second end, the second cavity having a second collar at the second cavity second end;

a butt portion;

a first pull rod being connected to the butt portion and comprising a plurality of first pull rod adjustment holes;

a second pull rod being connected to the butt portion and comprising a plurality of second pull rod adjustment holes;

a first bushing, the first bushing being retained within the first cavity;

a second bushing, the second bushing being retained within the second cavity;

a first spring within the first cavity between the first bushing and the first collar;

a second spring within the second cavity between the second bushing and the second collar;

a first pull rod lock, the first pull rod lock connecting the first pull rod to the first bushing via one of the plurality of first pull rod adjustment holes; and a second pull rod lock, the second pull rod lock connecting the second pull rod to the second bushing via one of the plurality of second pull rod adjustment holes, wherein:

a length of pull is determined by which of the plurality of first pull rod adjustment holes the first pull rod lock is secured to and which of the second pull rod adjustment holes the second pull rod lock is secured to, and during the recoil event, if the butt portion is offset from the body, the first bushing compresses the first spring against the first collar and the second bushing compresses the second spring against the second collar.

12. The stock of claim 11 wherein the butt portion comprises a butt pad and a butt pad mount, the first pull rod and the second pull rod being connected to the butt pad mount.

13. The stock of claim 11 wherein one of said plurality of first rod adjustment holes is a proximal hole that is located proximal to the butt portion, wherein the butt portion abuts the body when the first pull rod lock is secured to the proximal hole, whereby no recoil management is provided by the first spring.

14. The stock of claim 11 wherein the first spring has a spring rate that is independent of the length of pull.

15. The stock of claim 11 wherein the second pull rod is aligned parallel to the first pull rod.

16. The stock of claim 11 wherein the first bushing has a relief, and the stock further comprises a retainer to engage the relief to retain the first bushing in the first cavity.

17. A stock to absorb shock during a recoil event, the stock comprising:

a body comprising:

a firearm interface;

a cavity having a first end and a second end, the cavity having a collar at the second end;

a butt pad;

a pull rod, the pull rod having a plurality of adjustment holes;

a bushing, the bushing being retained within the cavity;

a spring within the cavity between the bushing and the collar; and a pull rod lock, the pull rod lock connecting the pull rod to the bushing via one of the plurality of adjustment holes creating a length of pull, wherein:

the length of pull is defined by which of the plurality of adjustment holes connected to the bushing with the pull rod lock; and the length of pull is independent of an amount of dampening provided by the spring.

18. The stock of claim 17 wherein the cavity is a first cavity and the pull rod is a first pull rod, the stock further comprising:

a second cavity;

a second pull rod;

a second bushing; and a second pull rod lock.

19. The stock of claim 18 wherein the second pull rod is aligned parallel to the first pull rod.

20. The stock of claim 17 wherein the bushing has a relief, and the stock further comprises a retainer to engage the relief to retain the bushing in the cavity.

* * * * *